US005601514A

United States Patent [19]

Horn

[11] Patent Number: 5,601,514

[45] Date of Patent: Feb. 11, 1997

[54] SWIMMING EXERCISE DEVICE

[76] Inventor: Tom Horn, 5521 Hawkes Bluff Ave., Davie, Fla. 33331

[21] Appl. No.: 544,967

[22] Filed: Oct. 30, 1995

[51] Int. Cl.[6] ..... A63B 69/12

[52] U.S. Cl. ..... 482/55; 434/254; 482/91

[58] Field of Search ..... 482/23, 55, 91; 434/254

[56] References Cited

U.S. PATENT DOCUMENTS

| | | | |
|---|---|---|---|
| 2,434,543 | 1/1948 | Borroughs | 434/254 |
| 3,140,550 | 7/1964 | Wayfield | 482/55 |
| 3,512,416 | 5/1970 | Hohwart | 482/55 |
| 3,724,012 | 4/1973 | Sanderson | 482/55 |
| 4,095,657 | 6/1978 | Hohwart | 482/55 |
| 4,218,056 | 8/1980 | Whitling | 482/55 |
| 4,247,096 | 1/1981 | Schmitt | 482/55 |
| 4,529,192 | 7/1985 | Stites | 434/254 |
| 4,530,497 | 7/1985 | Moran et al. | 482/55 |
| 4,552,540 | 11/1985 | Bass | 441/129 |
| 5,033,735 | 7/1991 | Erickson | 482/55 |
| 5,050,863 | 9/1991 | Yacoboski | 482/55 |

FOREIGN PATENT DOCUMENTS

| | | | |
|---|---|---|---|
| 3600061 | 7/1987 | Germany | 482/55 |

*Primary Examiner*—Jerome Donnelly
*Assistant Examiner*—Victor K. Hwang
*Attorney, Agent, or Firm*— Malloy & Malloy, P.A.

[57] ABSTRACT

A swimming exercise device structured to be worn around the user's waist and utilized inside a swimming pool having at least one generally vertical wall surface. The exercise device includes an elongate, rigid resistance member having a first end and a second end. Further, the exercise device, at the first end of the resistance member, is structured to facilitate, substantially stable, generally perpendicular abutted engagement of the resistance member with the wall surface and thereby prevent movement of the resistance member towards the wall surface of the swimming pool. Moreover, the exercise device, at the second end of the resistance member, is structured to be secured to an individual such that upon the individual swimming towards the first end of the resistance member, and hence the wall surface, in generally parallel relation to an axis of the resistance member, movement of the individual towards the wall surface of the swimming pool is prevented.

16 Claims, 2 Drawing Sheets

SWIMMING EXERCISE DEVICE

BACKGROUND OF THE INVENTION

1. Field of the Invention

The present invention relates to a safe, inexpensive, portable swimming exercise device which is utilized inside a standard swimming pool so that a user can engage in swimming exercises and enjoy the aerobic and cardiovascular benefits of swimming while remaining fixed in place, without interfering with the use of the pool by other swimmers, and without a substantial risk of becoming entangled or otherwise dangerously caught up therewith.

2. Description of the Related Art

Swimming is a remarkably popular form of recreation that is enjoyed by an increasing number of Americans every year. Indeed, during the hot and humid days of summer, the swimming pool becomes the premier attraction in outdoor recreational activities. Apart from its pure enjoyment value, however, many people have come to realize the immense health benefits that swimming provides. For many years, physicians have recommended swimming to patients of all ages for the excellent cardiovascular fitness exercise that it provides. Physical therapists likewise recommend swimming for its safe low impact conditioning of all the major muscle groups.

Indeed, the combination of the recreational and health benefits have led to increasing demand for municipal and public swimming pools, as well as private/residential swimming pools. For example, clubs such as the YMCA and/or the rare health club which make a swimming pool available to members, are becoming much more attractive to new members. Similarly, because of the increasing availability of swimming pools at hotels, many business and/or leisure travelers have become accustomed to swimming as a form of exercise, and in fact prefer to stay at hotels which have a swimming pool available for their guests. As to the residential setting, apartment complexes and/or new home developments are increasingly making swimming pools available to residents as an attractive selling point, a convenience which further encourages swimming as an exercise. In fact it is evident that as more places make swimming pools available, more and more people become hooked on swimming as a primary source of exercise.

Unfortunately, however, those private clubs such as the YMCA, have not been able to keep pace with this demand, and therefore face crowded conditions, particularly during the summer months. Similarly, due to space constraints and increased demand, most available community swimming pools at hotels, apartment complexes, home developments, etc., are shared by a large number of individuals and therefore face over crowded conditions if many people are attempting to simultaneously utilize the pool for recreation or exercise purposes. Furthermore, the typical backyard swimming pool, although adequate for pool lounging and leisure swimming, is often simply not large enough for the swimmer interested in serious cardiovascular, aerobic, muscle toning, or weight-loss exercises to swim meaningful lengths without having to turn around. As such, swimming exercise is most commonly done in an undersized pool, if a backyard swimming pool is accessible, or in a crowded setting wherein a swimmer must share a community, apartment, municipal, or country club pool with other users.

For serious exercise enthusiasts, the crowded conditions at community pools can become a significant hinderance.

The possibilities of injuries increase as divers, pool loungers, and lap swimmers all compete for limited pool space. There is therefore a significant need for a swimming exercise device which allows a swimmer to safely and effectively obtain a vigorous cardiovascular or aerobic workout in a small, well defined section of a swimming pool. Such containment allows the user to avoid injuries caused by bumping into other swimmers, contact with divers, or collisions with walls, ladders, slides, steps, or other objects. Moreover, these factors become increasingly important when dealing with children or handicapped swimmers, such as blind swimmers. Also, people who have weak eyesight are not able to enjoy the health benefits of swimming, especially because eyeglasses cannot be worn inside the swimming pool, and it is well-known that contact lenses are easily lost in swimming pools. In fact, swimmers who have imperfect vision often must swim visually unaided and usually hesitate to swim laps or move around much when other people are in the swimming pool.

For these and other reasons, others in the art relating to stationary swimming devices have attempted to provide devices that restrict a users movement and confine the user to a small, well defined section of a swimming pool. Generally, however, these devices restrain the swimmer through the use of tension cables and other complex equipment. For example, the patent to Greene (U.S. Pat. No. 5,344,373), provides a device which attempts to restrain the swimmer's movement through the use of cables connected to the swimmer's ankles, and attached to a stationary object outside of the swimming pool. Another example of such a device is the patent issued to MacLennan (U.S. Pat. No. 5,236,404). Here the swimmer must wear a floating harness which is connected by a string or cable to a stationary object outside the pool. Unfortunately, these devices, while restricting a swimmer's movement, are not optimally safe and effective for use. In essence, the string or cable acts as a radius, and the swimmer is still free to rotate within a circular motion around the point to which the string is attached. Further, because most swimming pools have a lack of rigid immovable objects around the perimeter of the pool, the string usually is attached to the pool ladder, diving board, or the slide. Obviously, in most swimming pools the area surrounding the pool ladder, the diving board, or the slide is the most crowded location in the swimming pool. Accordingly, a swimmer will often not feel comfortable using a swimming exercise device under those conditions as he or she may interfere with or be interfered with by others using the pool. Additionally, the underwater cables introduce a significant risk that children or other swimmers will become entangled in the apparatus. This risk is increased when one considers the fact that the swimmer is facing away from the cable or string and cannot see it while exercising. Furthermore, the likelihood that the swimmer himself or herself may become entangled in the cable or string should not be overlooked. Also, in such devices, the strength of the external object to which the wire is connected, and not the structure of the exercise device itself determines the capacity of the exercise force to be resisted.

In the Greene patent (U.S. Pat. No. 5,344,373), the cables are secured to the ankles of the swimmer. Not only is this uncomfortable and awkward for the user, but it is very dangerous as the swimmer may not be able to easily release the cables when needed. Other devices such as the patent issued to Moran et al (U.S. Pat. No. 4,530,497), and Bass (U.S. Pat. No. 4,552,540), which use harnesses, are, however, also inadequate. For example, the Moran device requires a tension cable tied to a flexible pole at the side of the swimming pool. While this device does not pose the same danger of other swimmers becoming tangled in the cable, since for the most part the cable is outside of the swimming pool, it can prove to be a major obstruction to people playing or walking outside the pool. Also, as with the Bass assembly which includes a large suspension frame that extends into the pool, the Moran device is not portable, since it is very awkward, inconvenient, and bulky to carry around, and requires a heavy weight or special socket or connection formed into the deck around the pool. Furthermore, these devices are very large and visible, thus, taking up a lot of extra space that may be used by other swimmers, and attracting attention to the swimmer from other swimmers or bystanders, thereby not allowing the user to concentrate on their workout and aerobic exercises without distraction by curious or inquisitive bystanders. Additionally, an inconspicuous exercise device is less likely to be objected to by lifeguards or pool supervisors than devices which are either highly visible or require attachment to objects surrounding the pool such as ladders, diving boards, slides, etc.

Accordingly, there is a need for a swimming exercise device which is convenient to use, safe, compact, and inconspicuous, and which allows a swimmer to obtain a rigorous workout while remaining fixed in place inside a swimming pool without interfering with the use of the pool by other swimmers. Moreover, there is a need for a device which does not need to be connected with a heavy weight or permanent fixture and will give a user tremendous flexibility in choosing a location for attaching the exercise device, such that the user can easily choose to avoid crowded, deep, shallow, sunny, warm, cold, or shady sections of the pool. Also, there is a need for a device which is substantially portable so as to permit a user to bring it with them to a community pool location or on trips.

Unlike related devices, the present invention is structured to occupy a negligibly small area of a swimming pool, since it is located underneath the swimmer during use, is not overly conspicuous to others around the pool, and offers significant privacy when used in that the swimmer is facing the wall of the swimming pool, and not looking out into a crowd of other swimmers.

SUMMARY OF THE INVENTION

The present invention is directed towards a swimming exercise device designed to be worn around the user's waist and utilized inside a swimming pool of the type, which includes at least one generally vertical wall surface, so that the user remains fixed in place while engaging in swimming exercises and enjoying the excellent aerobic and cardiovascular benefits of swimming.

The swimming exercise device includes primarily a generally elongate resistance member. Further, the resistance member is generally rigid and includes a first end and a second end. Disposed on the first end of the resistance member are abutment means. Specifically, the abutment means are structured to facilitate the maintenance of substantially stable, generally perpendicular abutted engagement between the resistance member and the generally vertical wall surface of the swimming pool. As such, movement of the resistance member towards the generally vertical wall surface of the swimming pool is substantially prevented.

Secured to the second end of the resistance member are harness means. The harness means are structured and disposed to be secured to an individual, thereby providing secure engagement between the individual and the resistance member. Moreover, the harness means function to prevent swimming movement of the individual towards the first end of the resistance member, and hence the generally vertical wall surface of the swimming pool engaged by the abutment means, upon the individual swimming towards the abutment means in a generally parallel orientation with an axis of the resistance member.

It is an object of the present invention to provide a swimming exercise device adaptable to a wide variety of pools which allows a user to remain fixed in place while engaging in swimming exercises.

It is a further object of the present invention to provide a swimming exercise device which is lightweight, compact, portable and may easily be dis-assembled for storage or transport, and re-assembled for quick and easy implementation at any swimming pool. It is also an object of the present invention to provide a swimming exercise device which can be attached to any wall of a swimming pool, and does not require the presence of ladders, slides, diving boards, or other fixed objects around or inside the pool, thus giving the user the flexibility to easily avoid crowded, high traffic, deep, or shady sections of a swimming pool.

Another object of the present invention is to provide a swimming exercise device which requires very little space when utilized in a swimming pool and does not interfere with use of the pool by other swimmers.

An object of the present invention is to provide a swimming exercise device which is submerged underwater during use and does not obstruct individuals outside the pool, or attract undue attention from other swimmers and bystanders.

An additional object of the present invention is to provide a swimming exercise device whereby the user may quickly and easily be released from the device in case of an emergency such as a muscle cramp, heart palpation, asthma attack, etc.

Another object of the present invention is to provide a swimming exercise device that may be used with or without a floatation aid so that it adapts to the skill, experience, and agility of the user.

It is a further object of the present invention to provide a swimming exercise device that prevents the user from being distracted by other swimmers and offers the user significant privacy by allowing him/her to face the wall of the swimming pool while exercising rather than looking out into a crowd of other swimmers.

It is also an object of the present invention to provide a swimming exercise device that can be utilized in a wide variety of pool depths.

Yet another object of the present invention is to provide a swimming exercise device which does not function to restrain the swimmer in the water, and can easily be removed from the water whether secured or unsecured to the user's body.

BRIEF DESCRIPTION OF THE DRAWINGS

For a fuller understanding of the nature of the present invention, reference should be had to the following detailed description taken in conjunction with the accompanying drawings in which.

Like reference numerals refer to like parts throughout the several views of the drawings.

DETAILED DESCRIPTION OF THE PREFERRED EMBODIMENT

Figures 1, 2:
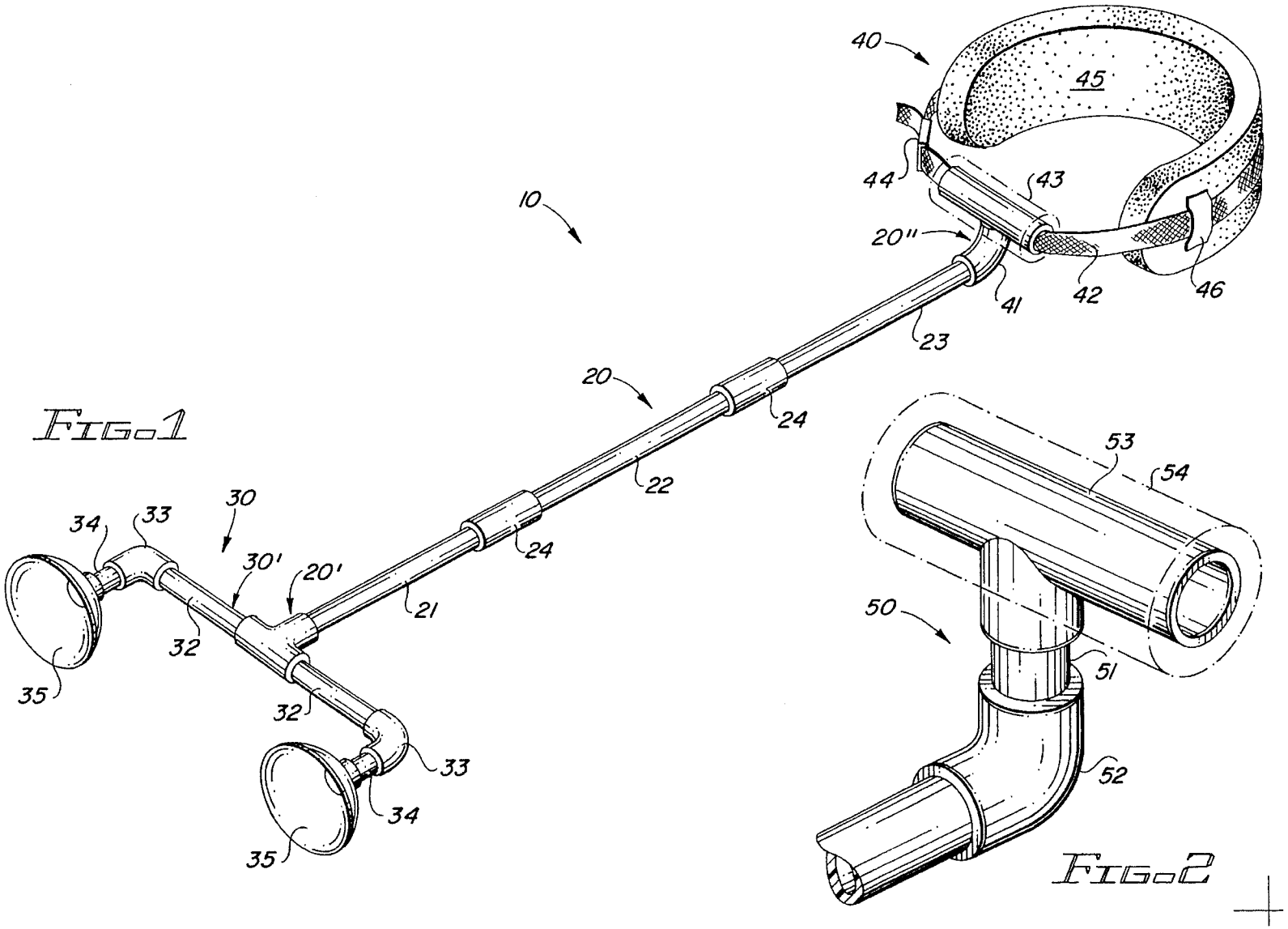
FIG. 1 is a perspective view of the swimming exercise device.
FIG. 2 is a perspective view of an alternative embodiment of the harness connector.
Figure 3:
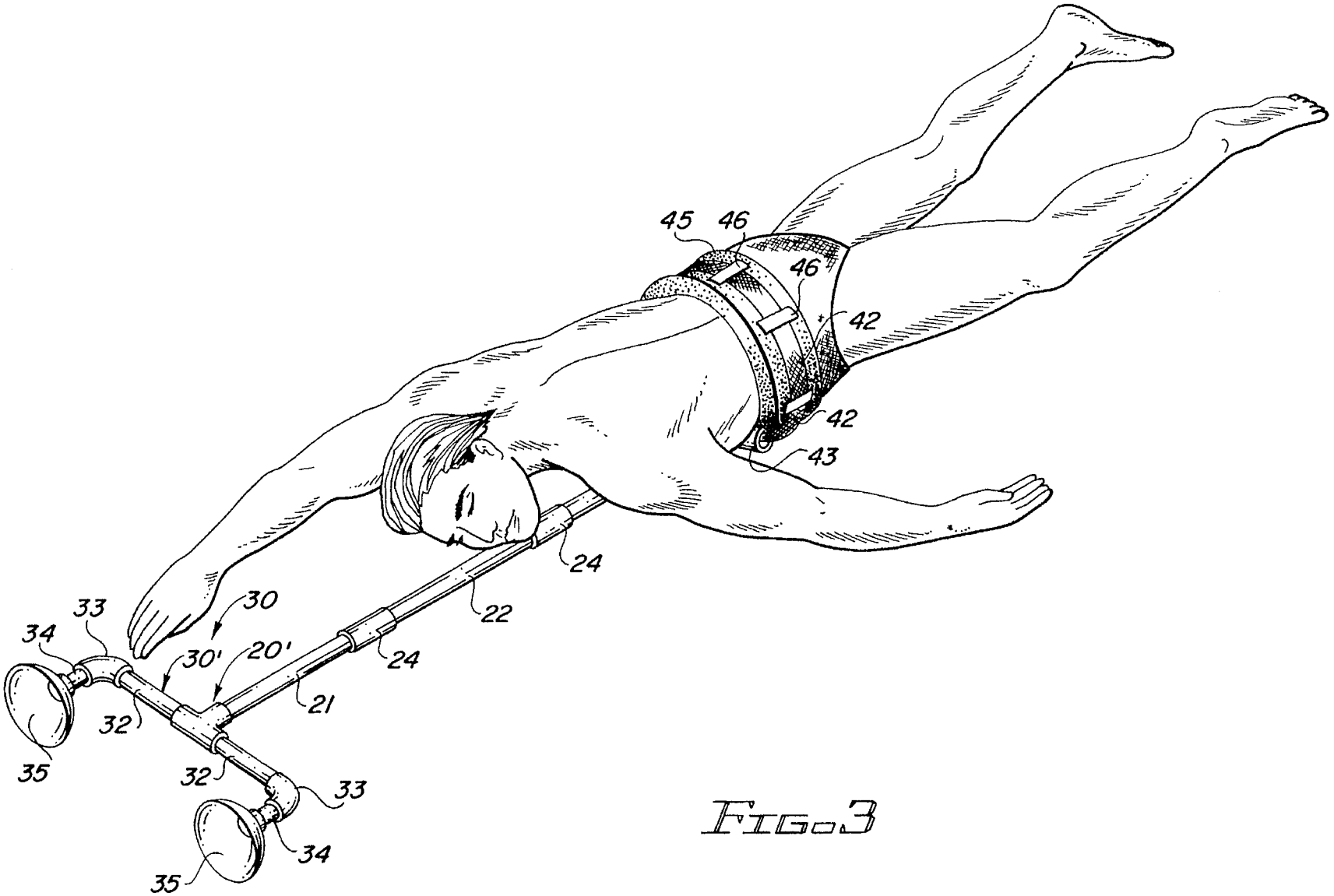
FIG. 3 is a side view of the present invention in use by a swimmer.

Shown in FIG. 1, the present invention is directed towards a swimming exercise device, generally indicated as 10. The exercise device 10 is structured to confine a user to a small, well-defined section of a swimming pool, while still allowing him/her to enjoy the excellent aerobic and cardiovascular benefits of swimming. Further, the exercise device 10 is structured for use inside a conventional above-ground or in-ground type swimming pool, which includes at least one generally vertical wall surface, without requiring any adaptation or obstruction of the exterior of the swimming pool or any fixed utility items associated with the swimming pool's use.

The exercise device 10 includes primarily a generally elongate, generally rigid resistance member 20. The resistance member 20, which includes a first end 20' and a second end 20", preferably includes a generally arrow, elongate tube which will not obstruct a user utilizing the exercise device and swimming thereover in axial alignment therewith. Preferably, the elongate, rigid, resistance member 20, is constructed of lightweight plastic, rigid vinyl, PVC, or another strong, yet lightweight material. Further, in the preferred embodiment, the elongate, rigid resistance member 20 includes at least one, but preferably a plurality of interlocking tubular members 21, 22, and 23. The interlocking tubular members, 21, 22, and 23, which are each constructed of the strong, yet lightweight material, are structured to be removably secured with one another so as to define the single elongate, rigid resistance member 20.

Although it is understood that the tubular members 21, 22, and 23 may be removably secured with one another in a variety of manners, in the preferred embodiment the tubular members 21, 22, and 23, are removably connected together by segment connectors 24. The segment connectors 24, which may be integrally formed as part of an end of one or more of the tubular members, or may be separately secured with tubular members 21, 22, and 23, are preferably female, increased diameter sockets that receive either a tapered or normal sized male end of the tubular members. Additionally, while generally the fitted interlocking connection between the sized male and female portions is sufficient to maintain secure engagement, especially because a swimmer's movement is directed towards further compressing/interlocking the tubular segments with one another, in an alternate embodiment, the segment connectors 24 may be threaded on the inside, and each of the tubular members 21, 22, and 23, includes a threaded exterior at its interlocking end. As such, a more secure interlocked engagement is achieved, and in the case of the separate segment connectors 24, each can receivably join two tubular members 21, 22, or 23 of the resistance member 20 with one another.

Further, the length of the aforementioned tubular members 21, 22, and 23 may be varied to provide for a larger or smaller resistance member 20, that is conveniently useable by children or taller individuals. Alternatively, use of the swimming exercise device by children or taller individuals may be facilitated simply by selectively removing or adding one or more of the tubular members to define the elongate, rigid resistance member 20. Moreover, by having the segment connectors 24 identically configured, the elongate, rigid resistance member 20 can be assembled in a variety of permutations, especially if one or more of the tubular members are of different sizes from one another. The swimming exercise device 10 of the present invention also includes abutment means 30. Specifically, the abutment means 30 are to be disposed on the first end 20' of the resistance member 20 so as to facilitate, substantially stable, generally perpendicular abutted engagement of the resistance member 20 with the wall surface of the swimming pool. Accordingly, through the abutted engagement of the resistance member 20 with the wall surface, movement of the resistance member 20 towards that wall surface is prevented and a user connected at the second end 20" of the resistance member, as will be described subsequently, and swimming towards the abutment means 30 at the wall surface, remains substantially stationary while engaging in swimming exercises.

Included as part of the abutment means 30, and secured at the first end 20' of the resistance member 20, is a generally T-shaped member 30'. As with the tubular members, the T-shaped member 30' is structured to be removeably linked so as to provide for secure interconnection as well as convenient disassembly and storage. Although the T-shaped member 30' may be a single element, in the preferred embodiment, the T-shaped member 30' is made up of a number of detachable, interlocking segments. A first of these segments of the T-shaped member 30' includes a T-Connector 31. Much like the resistance member 20, the T-connector 31, and the remaining interlocking segments of the T-shaped member 30', are preferably constructed of lightweight plastic, rigid vinyl, PVC, or another similar strong, yet lightweight material. The T-connector 31 is structured to be secured to the first end 20' of the resistance member 20 in much the same manner as the tubular segments 21, 22, and 23 are removeably secured with one another, and may similarly include a threaded interconnection socket structured to receive a corresponding tubular segment 21.

Further included as part of the T-shaped member 30' and extending from both sides of the T-Connector 31, in generally perpendicular relation to the elongate, rigid resistance member 20, are two cross braces 32. These cross braces 32 are preferably short tubular segments similar to the tubular segments 21, 22, and 23 which make up the elongate, rigid resistance member 20, and in fact may be structured to be interchangeable therewith, depending upon the needs of the user. Both ends of the cross braces 32 may be threaded on the outside or are specifically sized, so they may extend into secured engagement within the T-connector 31. Alternatively, the cross braces 32 may consist of a single continuous tubular member which goes through the T-Connector 31. Also, preferably, secured to the free ends of the cross braces 32, or integrally formed therewith, are a pair of generally 90 degree, bend connectors 33, and if necessary a pair of short tubular adapter segment 34.

The abutment means 30 of the present invention also include at least one, but preferably a pair of increased surface area panels 35. In the case of a single increased surface area panel 35, the aforementioned T-connector 31 is not required and the increased surface area panel 35 of the abutment means 30 can be directly secured to the first end 20' of the resistance member 20. So as to provide increased operational stability, however, in the preferred embodiment, illustrated in the figures, there are at least two increased surface area panels 35 disposed a spaced apart distance from one another and removeably secured to opposite ends of the T connector 31. As such, the increased surface area panels are structured to provide a stable point of engagement between the relatively narrow resistance member 20 and the wall surface of the swimming pool, thereby helping to maintain the generally perpendicular, operational orientation of the resistance member 20 relative to the wall surface when the user is swimming. Furthermore, in the preferred embodiment, each of the increased surface area panels 35 includes a generally flexible diaphragm, such as a suction cup 35. Such a suction cup 35 is constructed of a soft, resilient material so that it is pliable and may conform to the wall surface contours and/or angle of the wall surface. Additionally, the suction cup 35 is generally shallow so as to form a substantially strong, yet removable connection with the pool wall without leaving marks or otherwise damaging the wall surface.

It will be appreciated that the entire abutment means 30 does not have to be completely dis-assembled for transport or storage. Rather, significant portability is achieved by simply detaching the resistance member 20 from the T-connector 31. As such, the remainder of the abutment means 30 is preferably left intact, and indeed the various parts such as the suction cups 35, adapter segment 34, bend connectors 33, and cross braces 32 may even be permanently joined together.

Disposed opposite the abutment means 30, at the second end 20" of the resistance member 20 are harness means 40. The harness means 40 are structured to effectively strap the user into the swimming exercise device 10 at the second end 20" of the elongate, rigid resistance member 20. The second end 20" of the elongate, rigid resistance member 20, as has been previously described, may be threaded to provide for effective interconnection, but nevertheless is removeably joined with a harness connector 41 of the harness means 40. In the preferred embodiment, the harness connector 41 is constructed of a lightweight plastic, rigid vinyl, PVC, or other similar material and may be formed into a single molded piece. Further, one end of the harness connector 41 may be threaded, or otherwise sized/fitted on the inside to removeably join with the second end 20 of the elongate, rigid resistance member 20.

The harness connector 41 preferably forms a bend and extends upward in a generally vertical direction. This vertical configuration helps elevate the user above the elongate, rigid resistance member 20 so that it does not interfere with movement of the user's arms or legs during swimming. In particular, the vertical portion of the harness connector 41 preferably terminates in a T-shape, and in the preferred embodiment, the harness connector 41 includes a single piece which forms both the bend and the T-shape therein.

To provide comfort to the user, the harness connector 41 is preferably provided with a soft, resilient harness connector pad 43. As such, a swimmer generally swimming over the harness connector will not contact a rough, rigid surface. Also, in an alternative embodiment as shown in FIG. 2, the harness connector 50 may include a short tubular segment 51, a bend connector 52, a T-connector 53, and a harness connector pad 54. A possible advantage of this alternative is that the length of the short tubular segment 51 may be varied to provide greater separation between the user and the elongate, rigid resistance member 20 so that it does not interfere with the user's movement.

Further included in the harness means 40 is a harness belt 42. The harness belt 42 is structured to wrap around the user's waist and extend through the harness connector 41. In the preferred embodiment, the harness belt 42 is constructed of a durable, water-resistant material such as nylon. Additionally, the harness belt preferably includes an adjustable quick release buckle 44. The quick release buckle 44, which allows the size of the harness belt to be adjusted to fit the waist of the user, may take on a number of conventional configurations and is structured to secure the user to the exercise device 10. Furthermore, the quick release buckle 44 is equipped so that the user can disengage the harness belt 42 quickly and effortlessly, a feature which is important not only for the user's convenience, but is also a critical safety feature in the event of an emergency.

Also in the preferred embodiment, the harness means 40 of the swimming exercise device 10 are provided with a floatation belt 45. The floatation belt 45, which is constructed of a generally soft, resilient, buoyant material such as polyurethane foam, is designed to comfortably fit around the users waist and is used in conjunction with the harness belt 42. In the preferred embodiment, the floatation belt 45 is structured with several belt loops 46 positioned around the outer perimeter of the floatation belt 45. The harness belt 42 then slips through the various belt loops 46 on the floatation belt 45 so that it comfortably engages the floatation belt 45 around the user's waist. By using belt loops 46, the floatation belt 45 is made removable so that the harness belt 42 may be used alone in instances where extra buoyancy is not desired such as with experienced users. Additionally, the floatation belt 45 need not be disengaged from the harness belt 42 for storage or transport of the swimming exercise device, but can remain in the belt loops 46.

It is therefore appreciated that during use, an individual will dispose the harness means about their waist, and will engage the abutment means 30 with the vertical wall surface. At that point, the individual will begin swimming over the resistance member 20 with their legs extending behind the harness means 40 and their upper torso being disposed above the resistance member 20. As such, the elevation provided by the harness means 40 over the resistance member 20 is important depending upon the skill level of an individual, and may be as much as twelve inches if necessary. Accordingly, during use, as the body of the individual is aligned with the resistance member 20, the arms during a conventional forward stroke pass freely on opposite sides of the generally narrow resistance member 20 without engagement. Furthermore, the overall length of the resistance member 20 is preferably greater than a length of the upper torso and extended arms of the user. Also, for greater stability and adaptable use, in an embodiment not illustrated for clarity, the abutment means 30 may have a triangular type of orientation with three of the increased surface area panels 35, and the harness means 40 may include an upwardly extending flexible strip leading to the harness belt 42 from the connector 41.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To be used in a swimming pool of the type including at least one substantially vertical wall surface, a swimming exercise device comprising:

a substantially elongate, generally rigid resistance member, said resistance member including a first end and a second end, abutment means disposed on said first end of said resistance member, said abutment means being structured to facilitate, substantially stable, substantially perpendicular abutted engagement of said resistance member with the wall surface of the swimming pool so as to prevent movement of said resistance member towards the wall surface of the swimming pool, harness means secured to said second end of said resistance member, said harness means being structured and disposed to be secured to an individual such that upon the individual swimming towards the abutment means, in substantially parallel relation to a central axis of said resistance member, movement of the individual towards the wall surface of the swimming pool is prevented, and said harness means including a belt member structured to be secured about the individual's waist.

2. A swimming exercise device as recited in claim 1 wherein said resistance member includes a substantially narrow, elongate tube structured and disposed to remain substantially clear from contact with a limb of the individual during swimming.

3. A swimming exercise device as recited in claim 1 wherein said resistance member includes a plurality of interlocking tubular members structured to be detached from one another so as to substantially facilitate portability.

4. A swimming exercise device as recited in claim 3 wherein said plurality of interlocking tubular members are substantially narrow and elongate so as to remain substantially clear from contact with a limb of the individual during swimming.

5. A swimming exercise device as recited in claim 1 wherein said abutment means includes at least one increased surface area panel extending from said first end of said resistance member and structured to provide substantially stable, perpendicular abutted engagement of said resistance member with the wall surface.

6. A swimming exercise device as recited in claim 1 wherein said abutment means includes a pair of spaced apart increased surface area panels structured to abut the wall surface of the swimming pool and provide increased stability to said resistance member.

7. A swimming exercise device as recited in claim 6 wherein said increased surface area panels include a suction cup.

8. A swimming exercise device as recited in claim 7 wherein said suction cup is generally shallow so as to limit a suction engagement with the wall surface and thereby minimize damage to the wall surface.

9. A swimming exercise device as recited in claim 6 wherein said abutment means includes a substantially T-shaped member structured to be removably engaged with said first end of said resistance member, and including said pair of increased surface area panels disposed at opposite ends of a cross support thereof.

10. A swimming exercise device as recited in claim 1 wherein said belt member includes a generally soft, resilient material pad structured to engage the individual and provide comfortable engagement with the individual.

11. A swimming exercise device as recited in claim 10 wherein said material pad of said belt member is generally buoyant.

12. A swimming exercise device as recited in claim 1 wherein said belt member includes adjustable closure means structured and disposed to facilitate adjustable securing of the harness means about the individual.

13. A swimming exercise device as recited in claim 1 wherein said harness means includes an upwardly depending, connector segment secured to said second end of said resistance member and structured to maintain said harness means, and hence the individual to which said harness means are secured in a generally spaced apart, elevated position above said resistance member, while maintaining a swimming force exerted by the swimming individual on the resistance member along the central axis of the resistance member.

14. A swimming exercise device as recited in claim 13 wherein said connector segment is padded.

15. A swimming exercise device as recited in claim 13 wherein said connector segment is removable so as to facilitate storage.

16. A swimming exercise device as recited in claim 13 wherein said connector segment includes a tubular member through which said belt member extends.

* * * * *